US006149267A

United States Patent [19]

Geissmann

[11] Patent Number: 6,149,267

[45] **Date of Patent: *Nov. 21, 2000**

[54] INK CARTRIDGE FOR A PRINTING HEAD OF AN INK JET PRINTER

[75] Inventor: Jürg Geissmann, Zürich, Switzerland

[73] Assignee: Pelikan Produktions AG, Egg, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/838,180

[22] Filed: Apr. 16, 1997

Related U.S. Application Data

[63] Continuation of application No. 08/027,787, Mar. 8, 1993, abandoned.

[30] Foreign Application Priority Data

Mar. 10, 1992 [DE] Germany ..... 92 03 206 U
Jan. 7, 1993 [DE] Germany ..... 93 00 137 U

[51] Int. Cl.[7] ..... B41J 2/175

[52] U.S. Cl. ..... 347/87

[58] Field of Search ..... 347/86, 85, 84, 347/87, 92, 35, 44

[56] References Cited

U.S. PATENT DOCUMENTS

| | | | |
|---|---|---|---|
| 4,383,263 | 5/1983 | Ozawa et al. | 347/86 X |
| 4,558,326 | 12/1985 | Kimwa et al. | 347/86 X |
| 4,940,997 | 7/1990 | Hamlin et al. | 347/7 X |
| 4,998,115 | 3/1991 | Nevarez et al. | 347/87 X |
| 5,040,002 | 8/1991 | Pollacek et al. | 347/87 |
| 5,119,115 | 6/1992 | Buat et al. | 347/86 |
| 5,148,194 | 9/1992 | Asai et al. | 347/49 |
| 5,153,612 | 10/1992 | Dunn et al. | 347/87 |
| 5,162,817 | 11/1992 | Tajika et al. | 347/86 X |
| 5,280,299 | 1/1994 | Saikawa et al. | 347/87 |

FOREIGN PATENT DOCUMENTS

| | | | |
|---|---|---|---|
| 0418828 | 3/1991 | European Pat. Off. | 347/87 |
| 56-118868 | 9/1981 | Japan | 347/35 |
| 3032853 | 2/1991 | Japan | 347/84 |
| 3184873 | 8/1991 | Japan | 347/86 |
| 3197052 | 8/1991 | Japan | 347/86 |

*Primary Examiner*—David F. Yockey
*Attorney, Agent, or Firm*—Fay, Sharpe, Fagan, Minnich & McKee, LLP

[57] ABSTRACT

The ink cartridge comprises a casing closed on all sides, with a face wall having an aperture for receiving a tubular socket of the printing head. The casing contains a foam element impregnated with ink. It has locking elements for engaging arrester means of the printing head, as well as a second smaller aperture for feeding air. An elastomeric foil is provided between the face wall and the foam element, the foil having a hole smaller than the aperture and extending coaxially with the aperture. An edge zone of the smaller hole projects beyond an edge of the aperture and rests sealing against the sockets when the cartridge is inserted.

6 Claims, 3 Drawing Sheets

INK CARTRIDGE FOR A PRINTING HEAD OF AN INK JET PRINTER

This is a continuation of application Ser. No. 08/027,787 field on Mar. 8, 1993 now abandoned.

BACKGROUND OF THE INVENTION

A printing head for an ink jet printer with an exchangeable ink cartridge is specified in EP-A-402 241 as follows: On the base plate of the printing head, the jet plate is arranged on the one side and a holder for the ink cartridge on the opposite side. The cartridge contains a foam element that is impregnated with ink. On the side facing the base plate, the bottom of the casing of the cartridge has a hollow space that is sealed against the outside by a rubber plug and delimited against the foam element by a sieve. A needle projects from the base plate; the capillary of said needle communicates with the ink ducts of the jet plate by way of hollow spaces. When the cartridge is inserted, the rubber plug is pierced with the needle. The point of the latter then projects into the hollow space. The cover on the opposite side of the casing has a venting aperture that feeds into another hollow space. For a trouble-free operation, this solution requires that the first-mentioned hollow space always remains filled with ink, which, however, cannot be guaranteed particularly near the end of the ink supply.

SUMMARY OF THE INVENTION

The present invention is based on the problem of designing an ink cartridge of the above-specified type in such a way that the ink supply can be exploited in a superior way.

The ink cartridge according to the invention for a printing head of an ink jet printer comprises a casing that is closed on all sides and has a face wall having an opening for receiving a tubular socket of the printing head. The casing contains a foam element that is impregnated with ink. Furthermore, the casing has locking elements that engage in arrester means of the printing head, as well as a second smaller opening for feeding air.

BRIEF DESCRIPTION OF THE DRAWINGS

Exemplified embodiments of the invention are explained in the following on the basis of the drawings, in which.

DESCRIPTION OF THE EXEMPLIFIED EMBODIMENTS

Figure 1:
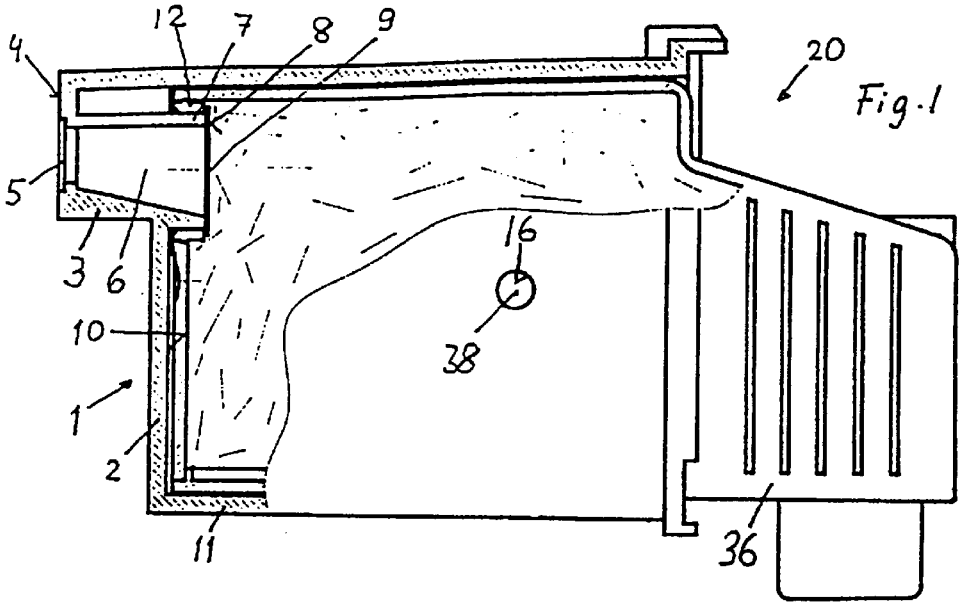
FIG. 1 shows a longitudinal section through a printing head with an ink cartridge.

In FIG. 1, the printing head 1 is only indicated schematically. Said printing head consists of a rectangular base plate

Figure 5:
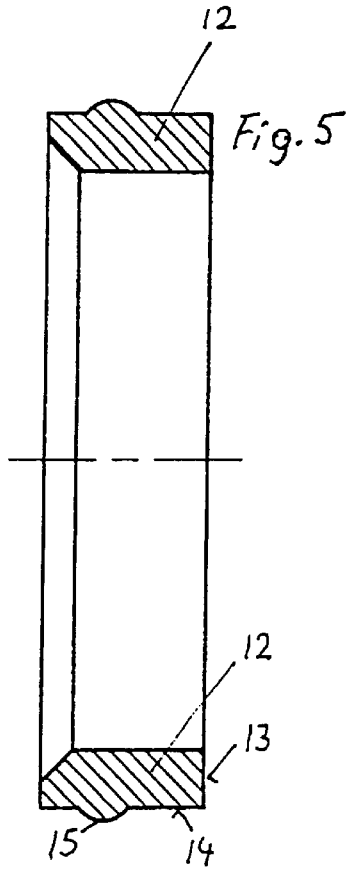
FIG. 5 shows an axial section through another seal.

2, from which a projection 3 protrudes along a narrow side. A jet plate 5 is installed in the face 4 of said projection 3. The jet plate 5 contains a row of narrow ink ducts. The pressure in said ducts can be increased piezo-electrically or thermo-electrically in a pulse-like way, so that a droplet of ink is ejected from the respective nozzle. The surface tension on the orifice of the nozzle subsequently draws the ejected ink volume by suction from an interior space 6 of a tubular socket 7, which space communicates with the jet ducts. The flat face 8 of the socket 7 is covered by a close-meshed sieve 9 and surmounts the back side 10 of the base plate 2. A prismatic tube with the four lateral walls 11 projects from the base plate 2 on the back side; an ink cartridge 20 is inserted in said tube. A sealing ring 12, which is shown in detail in FIG. 5, is mounted on the section of socket 7 that surmounts the back side. The elastomeric sealing ring 12, which, for example, is made of silicone rubber, is tubular and has a flat face 13 in front and a sealing bead 15 extending around the cylindrical outer circumference 14. The face 13 supports the projecting edge of the sieve 9 and protects the latter against tearing off when the cartridge 20 is pulled out. The sealing bead 15 seals the socket 7 against the casing of the cartridge. During operation, the face 4 is directed downwardly, and the interior space 6 is full of ink. For locking the cartridge 20 in place, the two opposed lateral walls 11 of the printing head 1 have the coaxial bores 16 forming arrests for lockingly engaging locking elements 38 of the cartridges.

Figure 2:
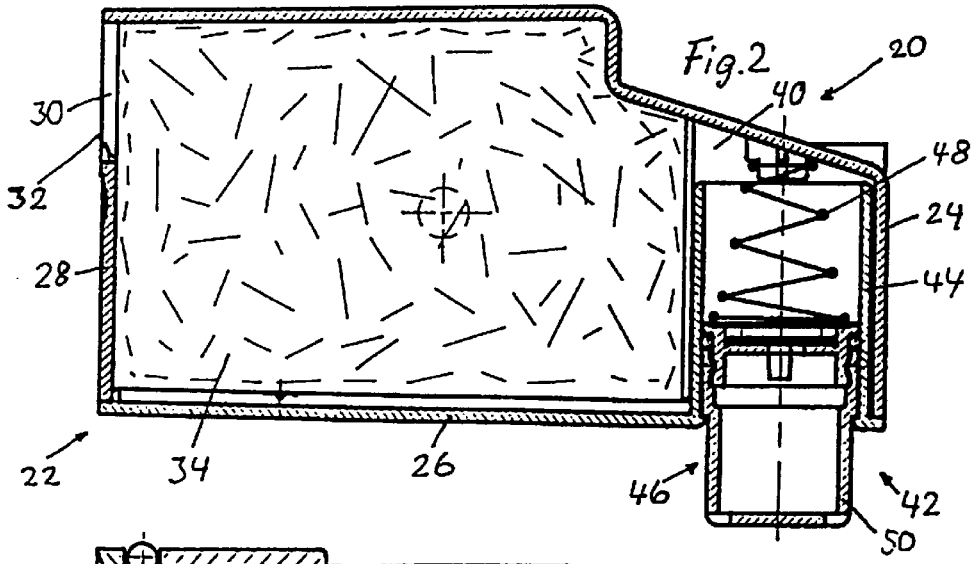
FIG. 2 shows a longitudinal section through the cartridge according to FIG. 1.

The ink cartridge 20 has a plastic housing 22 consisting of a hollow body 24 which, in the representation according to FIG. 2, is open on the bottom side, and closed by a cover 26, which is hot-sealed or glued to said body. A face wall 28 of the housing 22 has an aperture 30 with a cylindrical wall 32 for receiving the socket 7. The sealing bead 15 seals against the wall 32. The casing 22 is filled for the most part with an ink-impregnated foam element 34. Two lateral walls 36 of the casing 22 have the ball capshaped projections 38 for engaging the bores of the lateral wall 11 of the printing head 1.

On the side opposite the face wall 28, a hollow space 40 that can be filled with air or ink is formed between the foam element 34 and the casing 22. A pump element 42, which in the embodiment according to FIG. 2 is a piston pump, projects into said hollow space 40. A cylindrical tube 44 is formed by molding on the cover 26; a piston 46 is guided in said tube. The piston 46 is loaded by a spring 48 in the basic position shown in FIG. 2, in which position a piston skirt 50 projects beyond the casing 22.

Figure 3:
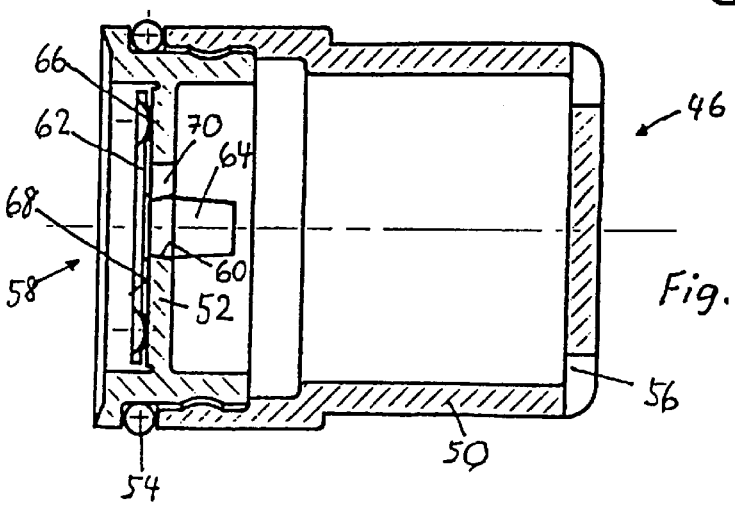
FIG. 3 shows an enlarged axial section through the plunger.

The piston 46 is shown enlarged in FIG. 3. Said piston consists of a piston bottom 52 and a skirt 50 snapped onto said bottom. An O-ring 54 sealing against the cylindrical inner wall of the tube 44 is inserted between two faces of the skirt 50 and the bottom 52. The interior space of the skirt 50 is connected with the atmosphere via the openings 56. The piston bottom 52 contains a check valve 58. A pin 64 formed by molding on a diaphragm 62, the latter being symmetrical with respect to rotation, is inserted in a center bore 60. The diaphragm 62 is made of an elastomer, for example silicone rubber. On its periphery, said diaphragm has a projecting, thin-walled, torus segment-shaped sealing bead 66 sealing against a flat face 68 of the piston bottom 52. The check valve 58 has a very low opening or closing pressure of a few millibar, for example 20 millibar at the most. An aperture 70 connects the outer side of the diaphragm 62 with the interior space of the skirt 50.

After the cartridge 20 has been inserted in the printing head 1, the skirt 50 of the pump element 42 is depressed until ink exits from the jet plate 5. During this operation, the printing head 1 with the jet plate 5 is usefully held in the lifted position, so that air can escape from the space 6. The interior space 6 is then filled with ink and the printing head 1 is ready for operation. When the skirt 50 is released, an under-pressure of a few millibar will subsequently prevail in the interior of the casing 22, so that no more ink can drip from the jet plate 5. Thus a simple and safe operation is achieved by designing the ink cartridge as specified above.

Preferably, the displacement volume of the piston 46 is slightly greater than the volume of the interior space 6; in this way, said space 6 can be filled with one single depression of the piston 46. However, due to the check valve 58 it is possible also to repeat the pumping action if one single depression should not suffice.

Figure 4:
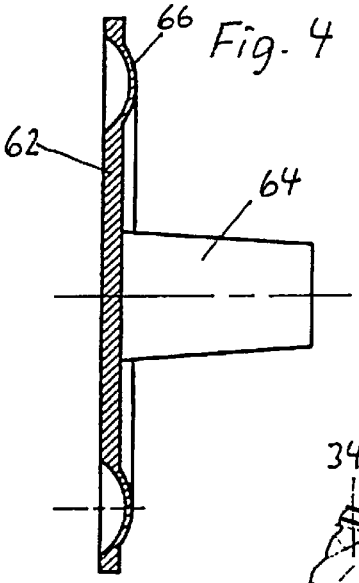
FIG. 4 shows an axial section through a seal.
Figure 6:
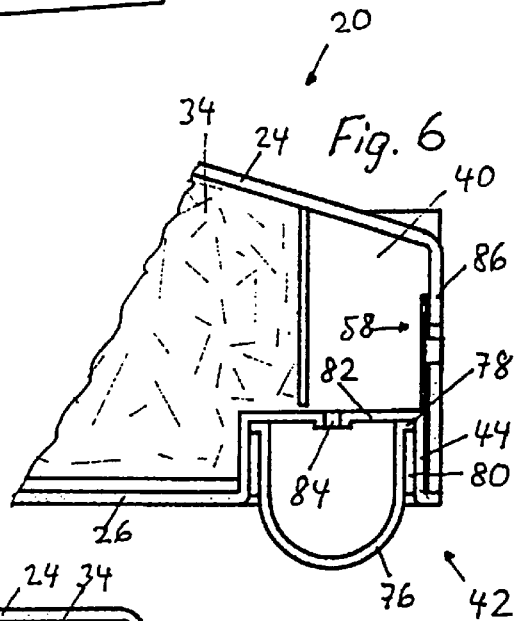
FIGS. 6 to 8 show variation of the embodiment according to FIGS. 2 to 4.
Figure 7:
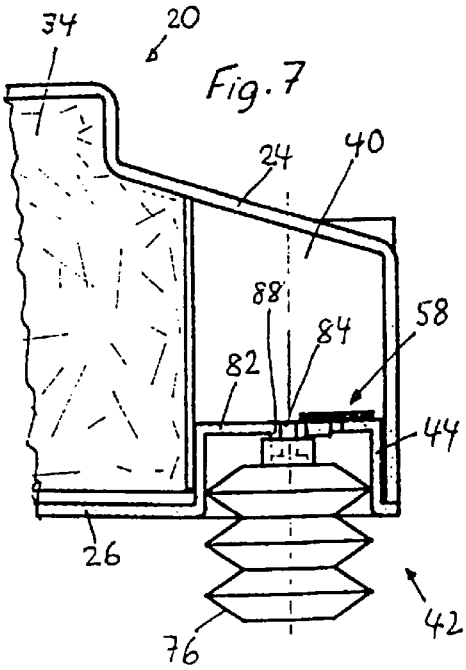
Figure 8:
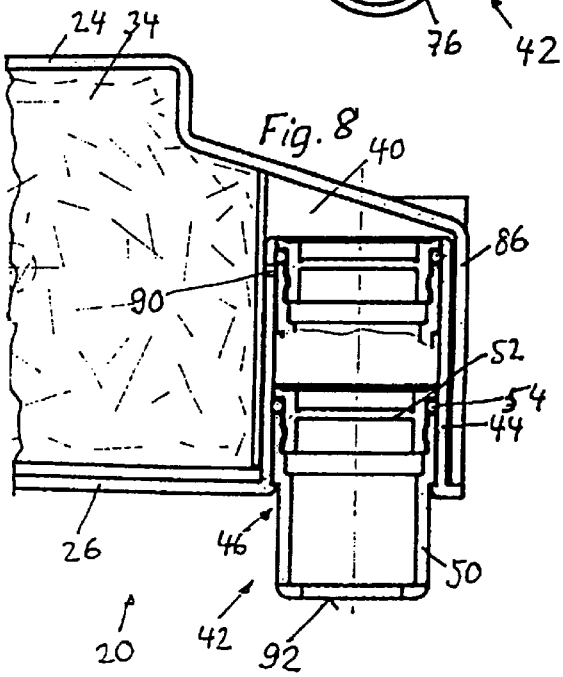

The embodiments according to FIGS. 6 to 8 differ from those according to FIGS. 2 to 4 only on account of the pump element 42, so that parts that are identical with the embodiment according to FIGS. 2 to 4 have been partly omitted in the representation according to FIGS. 6 to 8. Analogous parts are denoted by the same reference numerals, so that no detailed description of such parts is required.

With the embodiments according to FIGS. 6 and 7, the pump element 42 is a bellows-type pump. The pump element 42 according to FIG. 6 has a dome-shape elastomeric bellows 76 with a flange 78, which is clamped between a bushing 80, the latter being impressed in the tube 44, and a face wall 82 of the tube 44. The wall 82 has an aperture 84. The check valve 58, which, for example, can be the same as the one according to FIGS. 3 and 4, is installed in the present case in the face wall 86 of the casing 22, said face wall being disposed opposite the face wall 28.

With the variation according to FIG. 7, the bellows 76 is a siphon mounted on a tubular attachment 88 of the wall 82. In the present embodiment, the check valve 58 is mounted in the wall 82.

The embodiment according to FIG. 8 differs from the one according to FIGS. 2 to 4 in that the spring 48 and the check valve 58 are missing. In the present case, the cartridge 20 is inserted in the printing head 1 and the piston 46 is then pressed in two steps into the depressed position, which is shown as well. In a first step, the piston is pushed in such a way that the O-ring 54 is still on the side of a radial opening 90 in the tube 44 that faces the cover 26. Said position can be determined by having the outer face 92 of the piston skirt 50 aligned flush with the outer surface of the cover 26. In said position, one waits until ink exits from the jet plate 5, and the piston 46 is then displaced further, so that the space 40 now communicates with the outside atmosphere via the opening 90, a residual excess pressure in the space 40 is eliminated, and further air can flow later for replacing the consumed ink volume.

Deviating from the embodiment according to FIG. 8, the opening 90 can be arranged also, for example in the face wall 86, and sealed during shipment, for example by means of an adhesive tape. In this case, the "two-phase movement" consists of the depression of the piston 46 and the subsequent detachment of the adhesive tape.

In the shipping condition, the opening 30 of the casing 22 is sealed as well with an adhesive foil, which is then removed before the ink cartridge 20 is inserted in the printing head 1.

Figure 9:
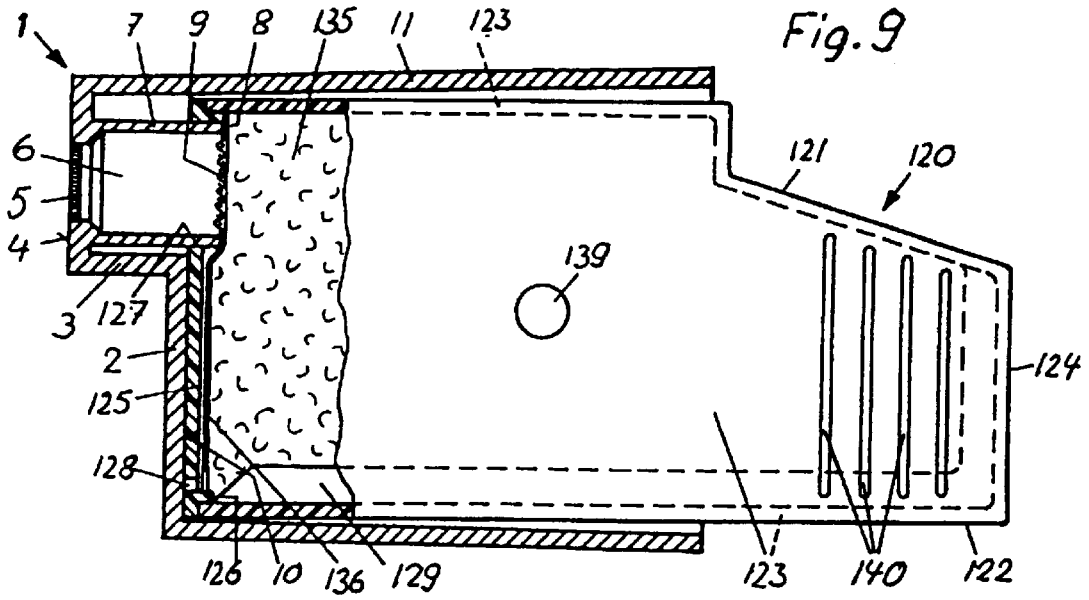
FIG. 9 shows a longitudinal section through a printing head with an inserted ink cartridge according to another embodiment.
Figure 10:
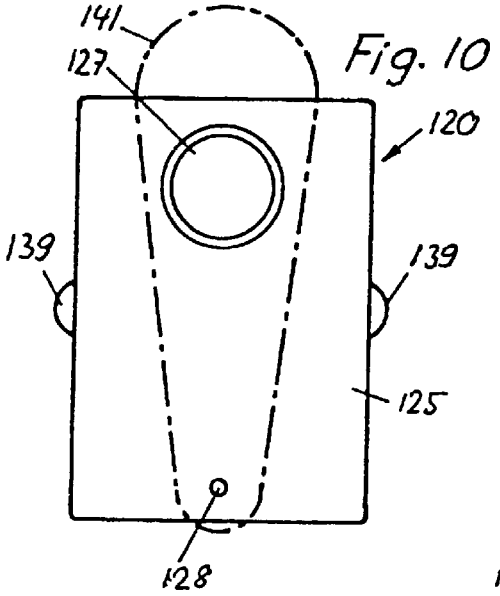
FIG. 10 is a front view of the cartridge according to the embodiment shown in FIG. 9.
Figure 11:
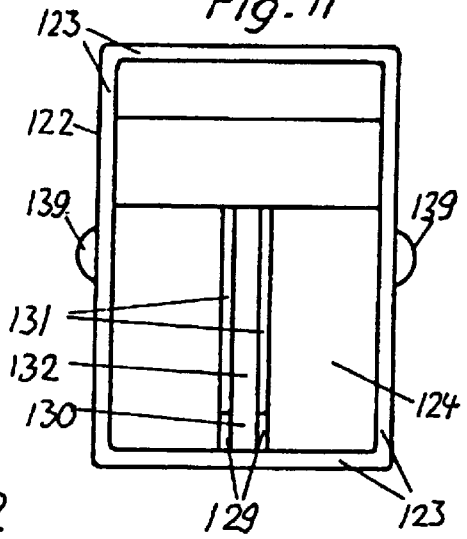
FIG. 11 shows a front view of a part of the casing.
Figure 12:
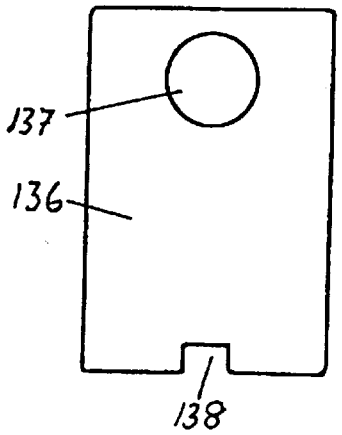
FIG. 12 shows a sealing foil.

In the embodiment according to the FIG. 9, the printing head 1 is the same as the one according to FIG. 1 except that the sealing ring 12 is missing.

The cartridge 120 of the embodiment according to FIG. 9 consists of a casing 121 with a prismatic hollow body 122, which is open on one side and which has four lateral walls 123 and a back wall 124 made of thermoplastic material, and a cover 125 sealed to the free face edge of the hollow body 121, for example by ultrasound welding. With a rim 126 that extends all around, the cover 125 engages the inside of the lateral walls 123 in a formlocking way. Adjacent to the one narrow side, the cover 125 has a bore 127, in which the socket 7 fits. Adjacent to the opposite narrow side, the cover 125 has a small venting hole 128 which is aligned with a duct 130 formed by closely adjoined inside ribs 129 on the one lateral wall 123. The duct 130 feeds on the back wall 124 into a hollow venting space 132, which is formed by ribs 131 as well.

A foam element 135 with open pores is inserted slightly compressed in the casing 121. A suitable foam material is, for example MELAMIN (registered trademark) foam material, or polyurethane foam material. The element 135 is impregnated with ink. An elastomeric sealing foil 136, for example a foil made of silicone rubber, is inserted between the foam element 135 and the cover 125, said foil having the size of the inside contour of the hollow body 122 on the free edge. Coaxially with the bore 127, the sealing foil 136 has a circular hole 137 with a smaller diameter. Together with the edge zone adjacent to said hole 137, the foil 136 seals the interior space of the casing 121 against the face 8 of the socket 7. The foil 136 has another recess within the area of the venting hole 128.

Two opposite lateral walls 123 of the hollow body 122 have in each case a ball cap-shaped locking projection 139. The projections 139 lock in matching bores of the lateral walls 11 of the printing head 1. In the part that is free when the printing head 1 is in the inserted position, two opposite lateral walls 123 of the casing 122 have the gripping cams 140 molded on said walls, which cams facilitate the removal of the cartridge 120 from the printhead 1. For shipment and storage, the bore 127 and the venting hole 128 are sealed with an adhesive tape or sealing foil 141. This ensures clean handling of the cartridge 120. Both apertures are sealed by the foil 141 at the same time, which means that the venting hole 128 cannot remain closed if a mistake is made when the cartridge 120 is inserted. No safe operation of the printing head 1 would be possible with said hole closed. For said reason, arranging the venting hole 128 in the cover 125 is advantageous. The ducts 130, 132 formed by the ribs 129, 131 nevertheless ensure that atmospheric pressure is admitted to the foam element 135 from the opposite side of bore 127, which is desirable.

When the cartridge 120 is inserted in the printing head 1, the socket 7 compresses the foam element 135 locally and thus simultaneously forces a supply of ink into the interior space 6 of the socket 7. In this way, a reliable operating of the printing head 1 is achieved immediatly after the cartridge 120 has been inserted. The further feed of ink until the ink supply has been exhausted is ensured because the relatively large ares of the sieve 9 of the socket 7 applies pressure directly to the foam element 135. The contact pressure of the foam element 135 against the sieve 9 of the socket 7 can be assured by a form-locking engagement of the locking projection 139 in the locking bores of the printing head 1.

I claim:

1. An ink cartridge for feeding ink to a printing head of an ink jet printer, the printing head having a tubular socket with a flat end face closed off by a sieve and an arrester, said ink cartridge comprising:

a cartridge casing closed on all sides by walls including a face wall, said face wall having a first aperture for receiving the tubular socket with the flat end face, said casing having a second aperture for feeding air to the ink cartridge, locking elements on said casing for lockingly engaging the arrester of the printing head, and ink within said casing, said casing further comprising a prismatic hollow body having an opening on one side and having four lateral walls, said walls having free ends, with said wall face being fastened on the free ends of said walls, an elastomeric foil between said face wall and said foam element, said foil having a hole smaller than said first aperture and extending coaxially with said first aperture and wherein an edge zone of the smaller hole projecting beyond an edge of said first aperture rests sealing against the socket when the cartridge is inserted.

2. Ink cartridge according to claim 1, wherein said second aperture is arranged in said face wall and, via a duct arranged in the interior space of the casing, communicates with a hollow space on the side of the foam element opposing said face wall.

3. Ink cartridge according to claim 2, wherein said duct and said hollow space are each formed by two adjacent ribs on the inside of the casing.

4. Ink cartridge according to claim 1, wherein said first aperture and said second aperture are sealed for shipment by means of an adhesive tape or a sealing foil.

5. Ink cartridge according to claim 1, wherein said locking elements are projections on opposite lateral walls of the casing.

6. Ink cartridge according to claim 1, wherein two opposite lateral walls of the casing have gripping cams disposed at an end remote from the face wall, said gripping cams facilitating removal of the cartridge from the printing head.

* * * * *